US005636542A

United States Patent [19]

Yamakawa et al.

[11] Patent Number: 5,636,542

[45] Date of Patent: Jun. 10, 1997

[54] PIERCING-ROLLING METHOD AND PIERCING/ROLLING APPARATUS FOR SEAMLESS STEEL TUBE

[75] Inventors: Tomio Yamakawa; Chihiro Hayashi; Kazuhiro Shimoda, all of Osaka, Japan

[73] Assignee: Sumitomo Metal Industries, Ltd., Osaka, Japan

[21] Appl. No.: 435,871

[22] Filed: May 5, 1995

[51] Int. Cl.[6] ..... B21B 19/04

[52] U.S. Cl. ..... 72/97

[58] Field of Search ..... 72/97

[56] References Cited

FOREIGN PATENT DOCUMENTS

| | | | |
|---|---|---|---|
| 0 550 256 | 7/1993 | European Pat. Off. . | |
| 59-47605 | 11/1981 | Japan . | |
| 63-90306 | 10/1986 | Japan . | |
| 169110 | 7/1993 | Japan | 72/97 |

OTHER PUBLICATIONS

"Investigation of Wall Thickness Variation of Tubes in Skew Rolling", Stal in English, Aug., 1970, p. 632–635.

*Primary Examiner*—Lowell A. Larson

*Attorney, Agent, or Firm*—Burns, Doane, Swecker & Mathis, LLP

[57] ABSTRACT

A method for manufacturing seamless steel tubes by the Mannnesmann tube making process wherein a billet is passed through a piercer and the center of the billet is pierced through to obtain a hollow shell. A pair of disk rolls are disposed to incline by a skew angle δ with respect to a pass line toward cone-type main roll located at the entry side, where a material to be rolled enters into the disk roll sliding face, thereby to become unparallel with the outlet face angle of the main roll, while the skew angle δ is set to satisfy the following conditions related to the skew angle δ, the inlet face angle θ1 and the outlet face angle θ2 of the main roll, thereby to obtain expansion ratio of outer diameter of 1.15 or higher value.

$$\theta 2+2^\circ<\delta<9^\circ,\ \delta+\theta 1<12^\circ$$

The piercing/rolling operation with high expansion ratio of outer diameter is carried out stably without occurrence of such troubles as incompleted release from the main rolls, flaw on the outer surface and incompleted engagement.

9 Claims, 15 Drawing Sheets d : OUTER DIAMETER OF MATERIAL $$r_{\theta L} = \frac{\pi d}{L}$$

PIERCING-ROLLING METHOD AND PIERCING/ROLLING APPARATUS FOR SEAMLESS STEEL TUBE

BACKGROUND OF THE INVENTION

1. Field of the Invention

The present invention relates to a piercing/rolling method and a piercing/rolling apparatus which use a piercer employed in the Mannesmann tube making process that is a representative process of manufacturing seamless steel tubes.

2. Description of Related Art

Manufacture of seamless steel tube by the Mannesmann tube making process is generally carried out as follows; first, a hollow shell is obtained by passing a billet (round steel ingot) through a piercer and piercing the center of the billet, which is further rolled to elongate by means of a plug mill, for example, either as it is or after being processed in an elongating mill for explaining and rolling as required, then smoothed, corrected in the form and sized by means of a smoothing mill or a sizing mill, and subjected to a finishing process to obtain a seamless steel tube as the finished product. As the piercer and the elongating mill described above, a so-called inclined rolling mill is used which combines main rolls, of which axial line is inclined with respect to the pass line of a material to be rolled, and a plug.

The piercer used in the Mannesmann tube making process described above generally has a pair of main rolls disposed to oppose each other while interposing the specified pass line, a plug disposed along the pass line as an inner surface regulating tool and guide shoes or disk rolls disposed to oppose each other while interposing the pass line as tube guiding members.

FIG. 1 is a schematic plane view of the piercer used in the Mannesmann tube making process, and FIG. 2 is a cross sectional view taken along the line II—II of FIG. 1. In FIGS. 1, 2, numerals 21A, 21B denote the main rolls, numeral 2 denotes a plug used as the inner surface regulating tool, and numerals 31*u*, 31*d* denote disk rolls used as the tube guiding members. Letter B denotes the billet, namely the material to be rolled which is transferred in the direction indicated by the hollow arrow mark Y, then pierced and rolled to become a hollow shell H that is drawn out. Therefore the inlet side of the piercing process is located at the left and the outlet side of the piercing process is located at the right in FIG. 1. FIG. 2 shows the cross section viewed from the inlet side of the piercing process.

As shown in FIG. 1, the main rolls 21A, 21B have gorge portions 41 near the middle portion in the axial direction thereof where each roll has the maximum diameter, the gorge portion being interposed by two conical portions of diameters gradually reducing toward the one conical portion ends having an inlet face 42 of inlet face angle θ1 and the other conical portion having an outlet face 43 of outlet face angle θ2, thereby forming an overall configuration of barrel type, while the main rolls 21A, 21B are disposed to oppose each other on the right and left or over and below the pass line X—X of the billet B. The main rolls 21A, 21B are driven by electric motors not shown in the drawing.

The plug 2 has an overall configuration of a bullet, with the base end thereof being supported on the tip of a mandrel bar M. The plug 2 is positioned on the pass line X—X to be held thereon at the middle of space between the main rolls 21A, 21B, and is capable of rotating about the pass line X—X. The base end of the mandrel bar M is linked to a thrust block which is not shown in the drawing.

As shown in FIG. 2, the disk rolls 31*u*, 31*d* have disk forms having concave surfaces on the periphery that face the plug 2, and are disposed to oppose each other on the right and left or over and below the pass line X—X in such a configuration as arranged alternately with the main rolls 21A, 21B. The disk rolls 31*u*, 31*d* are driven by electric motors not shown in the drawing.

In the piercer of such a configuration as described above, when the main rolls 21A, 21B are driven to rotate in the directions of the arrow marks of FIG. 2, the billet B being transferred in the direction Y along the pass line X—X is engaged between the inlet faces 42, 42 of the main rolls 21A, 21B thereby to be pierced while rotating clockwise around the pass line X—X when viewed from the inlet side of the piercing process. Thus the billet B is pierced by the plug 2 while being pressed on both sides by the gorge portions 41 of the main rolls 21A, 21B, to become the hollow shell H which is drawn out.

Techniques to carry out the piercing/rolling operation with the disk rolls being inclined with respect to the pass line in such a direction that improves the piercing efficiency of the material in the piercer employing disk rolls have been disclosed, for example, in the Japanese Patent Application Publication No. 59-47605 (1984).

The deformation form of the material in the course of piercing at the outlet side of the piercing process from the gorge portion of the main roll in the piercing/rolling operation of the prior art is shown in FIG. 3 which is contained in a published document (STAL IN ENGLISH, AUGUST, 1970, pp. 632–635), showing that bulging of the outer diameter of the material on the side that is engaged by one of the main rolls is larger than that of the material on the side leaving the other main roll. This is explained as follows with reference to FIG. 4 that shows an example of configuration provided with disk rolls. The bulging of the portion (part B in drawing) that is being engaged by the main roll 21B is larger than the bulging of the portion (part A in drawing) that is leaving the main roll 21A. Therefore, a pair of tube guiding members for suppressing the bulging of the outer diameter of the material are usually provided between the main rolls 21A and 21B, above and below the pass line in the case shown in FIG. 4.

In an ordinary piercing/rolling process wherein the expansion ratio of the outer diameter (ratio of the outer diameter of the material after piercing to the outer diameter of the material before piercing, namely the material outer diameter after piercing divided by the material outer diameter before piercing) is in a range from 1.0 to 1.05, the bulging of the outer diameter of the material at part B shown in FIG. 4 does not pose a problem. When the expansion ratio of the outer diameter increases, however, the circumferential length of the material at the outlet side of the main roll increases and therefore the bulging at part B becomes greater than the bulging at part A of FIG. 4, thereby making the contact angle ϕ of the main roll 21B greater than in the case of ordinary piercing/rolling operation. As a result, when a non-stationary piercing/rolling operation (piercing/rolling with high expansion ratio of outer diameter) is carried out wherein the thrusting force in the rolling direction becomes smaller, problems occur such as the incomplete release from the main rolls caused by the inability of the material to rotate during rolling the bottom of the tube material, the form of the bottom portion of the hollow shell becoming elliptical in configuration and the shoe mark flaws generated on the outer surface of the hollow shell.

Piercers configured by disposing disk rolls in an inclined arrangement in order to prevent the material from being squeezed into the space between the disk rolls and the main rolls are disclosed, for example, in the Japanese Patent Application Laid-Open No. 63-90306 (1988).

While the piercer disclosed in the Japanese Patent Application Publication No. 59-47605 (1984) employs such a configuration as a disk roll used on one side and a fixed guide used on the other side, the piercing speed is increased in case disk rolls are used on both sides and are inclined toward the main roll 21B as shown in FIG. 5. However, increasing the expansion ratio of the outer diameter leads to increased resistance against the material near the edge of the outlet side thereof in the sliding face of the disk roll, resulting in such problems as seizure of the edge or damage on the circumferential surface of the material at the edge causing shoe mark flaws to remain on the product, and stoppage of the piercing process due to increased contact angle $\phi$ of the main rolls in the rotating direction of the material.

SUMMARY OF THE INVENTION

Main object of the invention is to provide a piercing/rolling method and a piercing/rolling apparatus for seamless steel tube which are capable of manufacturing hollow shells of good external surface quality without causing mis-rolling such as incomplete release from the main rolls during rolling the bottom of the material, and capable of carrying out piercing/rolling operation with a high expansion ratio of the outer diameter of 1.15 or higher value.

According to the invention, a plug is disposed along the pass line between a pair of cone-type main rolls and a pair of disk rolls arranged alternately with each other around the pass line and, when a material to be rolled is pierced and rolled by screwing and moving the material forward to obtain a seamless steel tube, each disk roll is disposed to incline by a skew angle $\delta$ with respect to the pass line toward the main roll located at the side where the material enters into the disk roll sliding surface thereby to become unparallel with the direction that defines the outlet face of the main rolls, while the skew angle $\delta$ is set to satisfy the following conditions (1) and (2) so that an expansion ratio of outer diameter of 1.15 or higher value is obtained.

$$\theta 2+2^\circ<\delta<9^\circ \quad (1)$$

$$\delta+\theta 1<12^\circ \quad (2)$$

where $\theta 1$ is the inlet face angle of the main roll $\theta 2$ is the outlet face angle of the main roll.

The above and further objects and features of the invention will more fully be apparent from the following detailed description with accompanying drawings.

DESCRIPTION OF THE PREFERRED EMBODIMENTS

First, the operating principle of the invention and the process of defining the values of the skew angle of the disk rolls and the expansion ratio of outer diameter will be described below.

According to the invention, with main rolls used in the piercing/rolling operation having a cone-type configuration and disk rolls being inclined at a specified angle in a specified direction with respect to a pass line (the angle is called the skew angle), inlet face angle and outlet face angle of the main rolls (the face angles are the angles of the main rolls to the pass line when the feed angle of the main rolls is zero) and the skew angle are related in particular relationships so that a velocity component is given to the material in a direction reverse to the rotating direction by means of the disk rolls, thereby restricting the bulging of the material outer diameter at the engagement by the main rolls in the rotating direction of the material, preventing the occurrence of mis-rolling and shoe mark flaw and suppressing the shear strain due to surface twist which is an additional shearing deformation.

Figure 1:
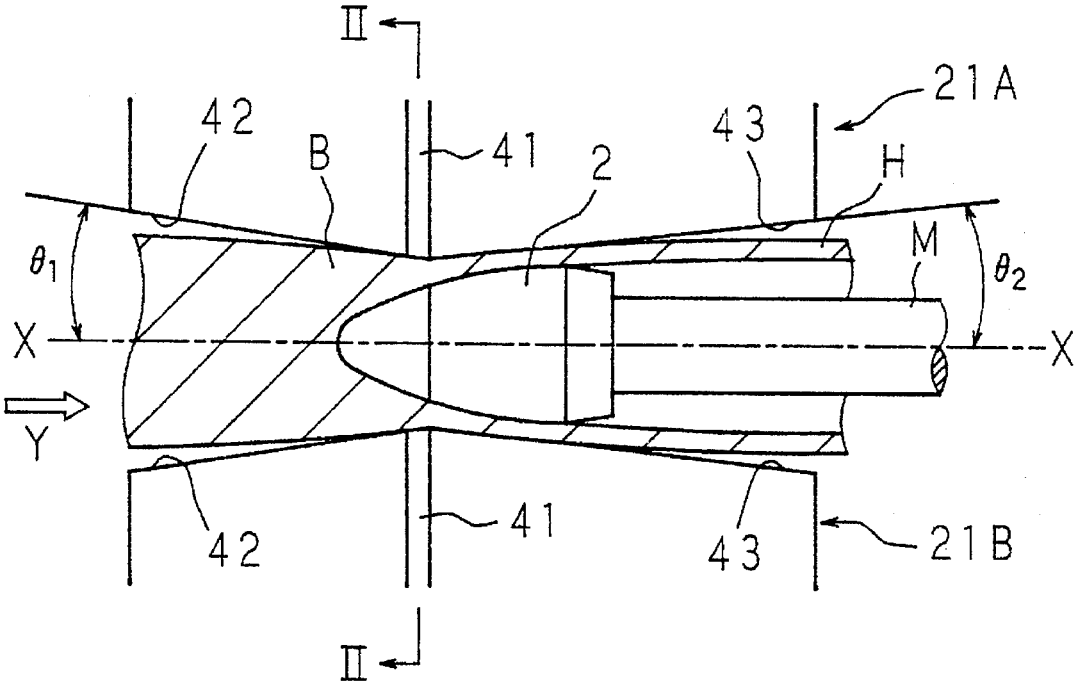
FIG. 1 PRIOR ART
FIG. 1 is a schematic plane view of a piercer used to carry out the piercing/rolling method of the prior art.
Figure 2:
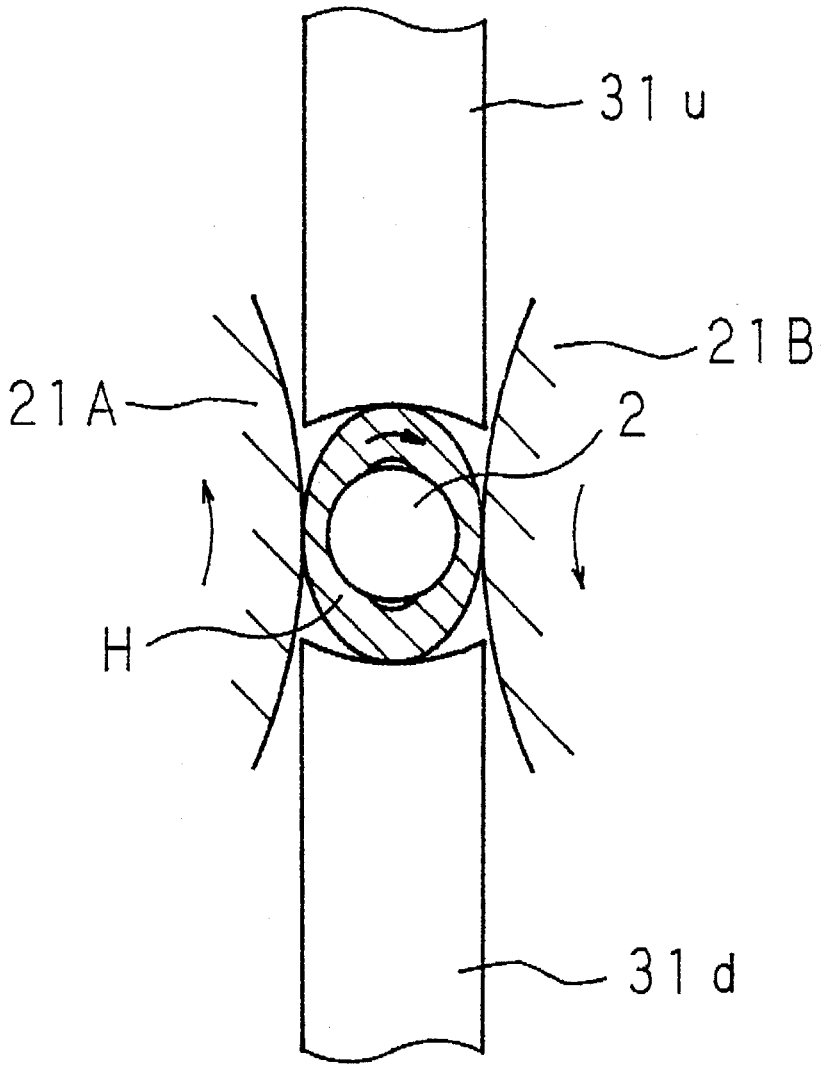
FIG. 2 PRIOR ART
FIG. 2 is a cross sectional view taken in the line II—II line of FIG. 1.
Figure 3:
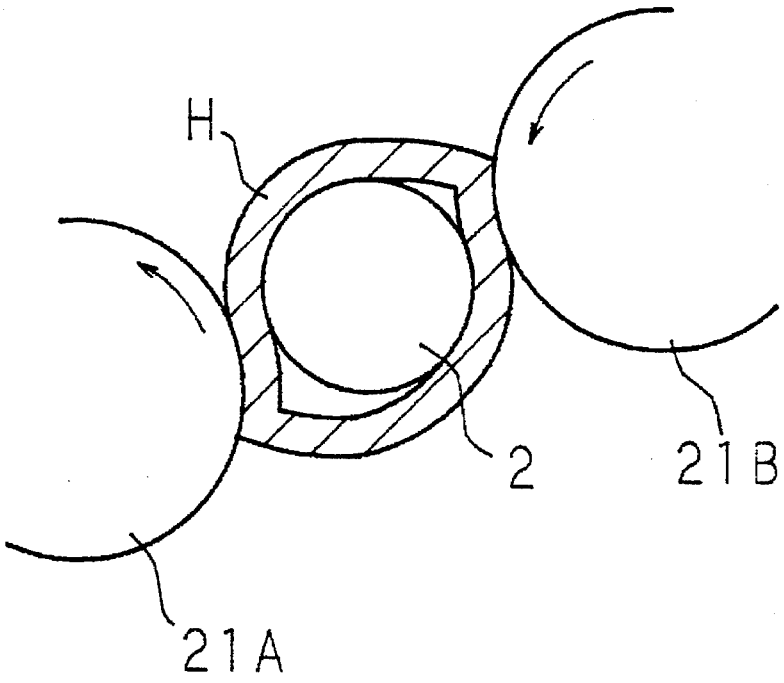
FIG. 3 PRIOR ART
FIG. 3 is a cross sectional view showing the state of piercing/rolling operation for the explanation of problems of the prior art.
Figure 4:
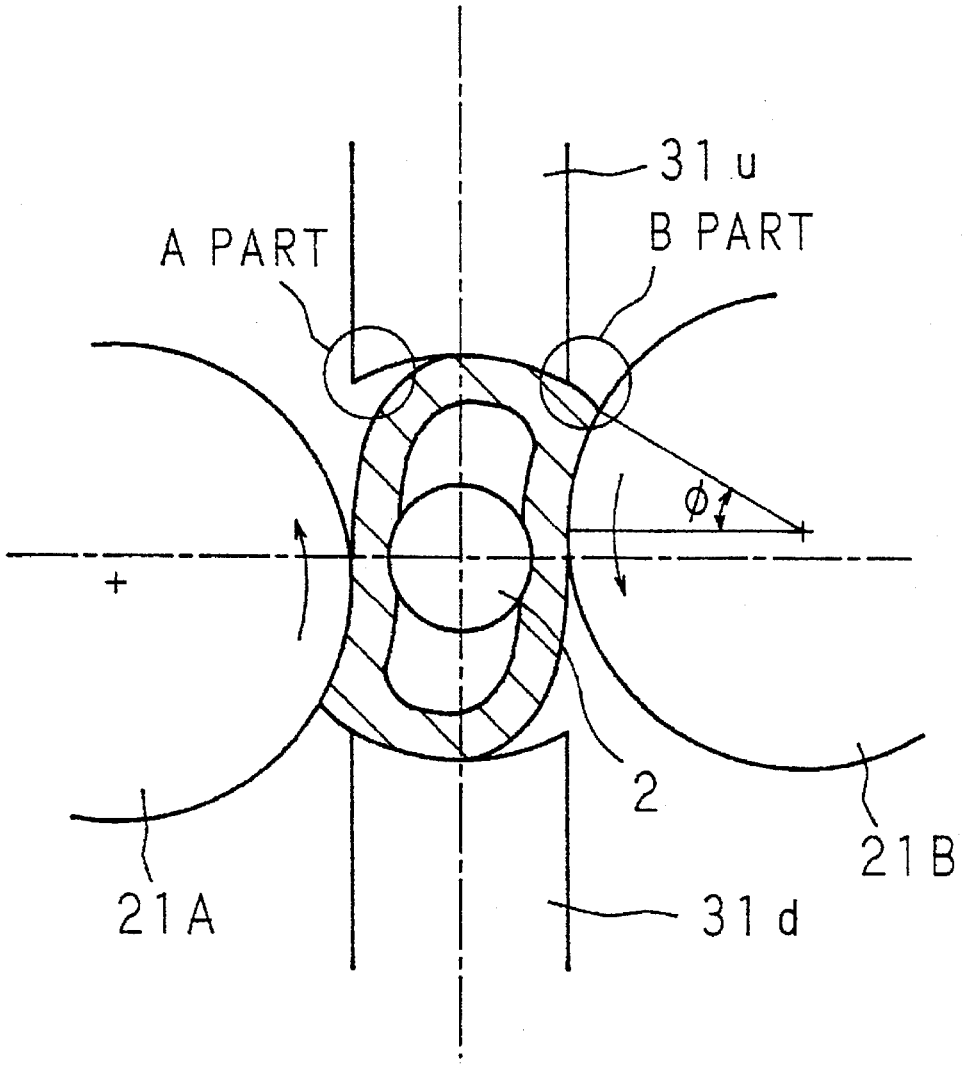
FIG. 4 PRIOR ART
FIG. 4 is a cross sectional view showing the state of piercing/rolling operation for the explanation of problems of the prior art.
Figure 5:
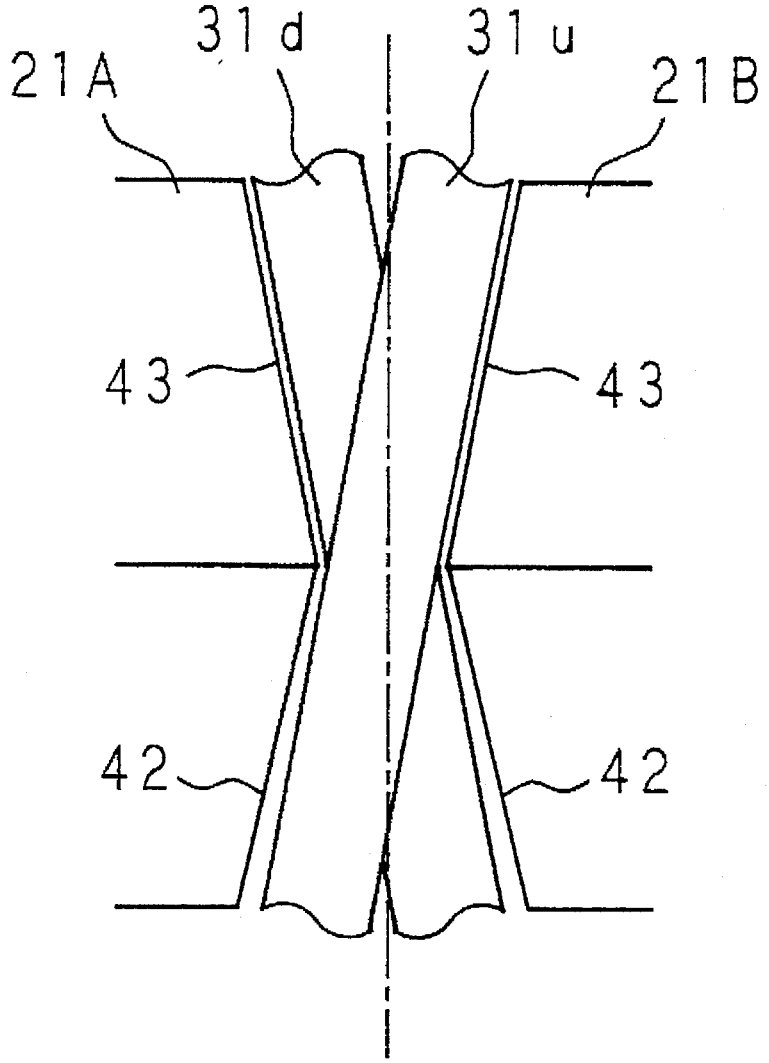
FIG. 5 PRIOR ART
FIG. 5 is a schematic top view of the piercer of the prior art where the/disk rolls are inclined.
Figure 6:
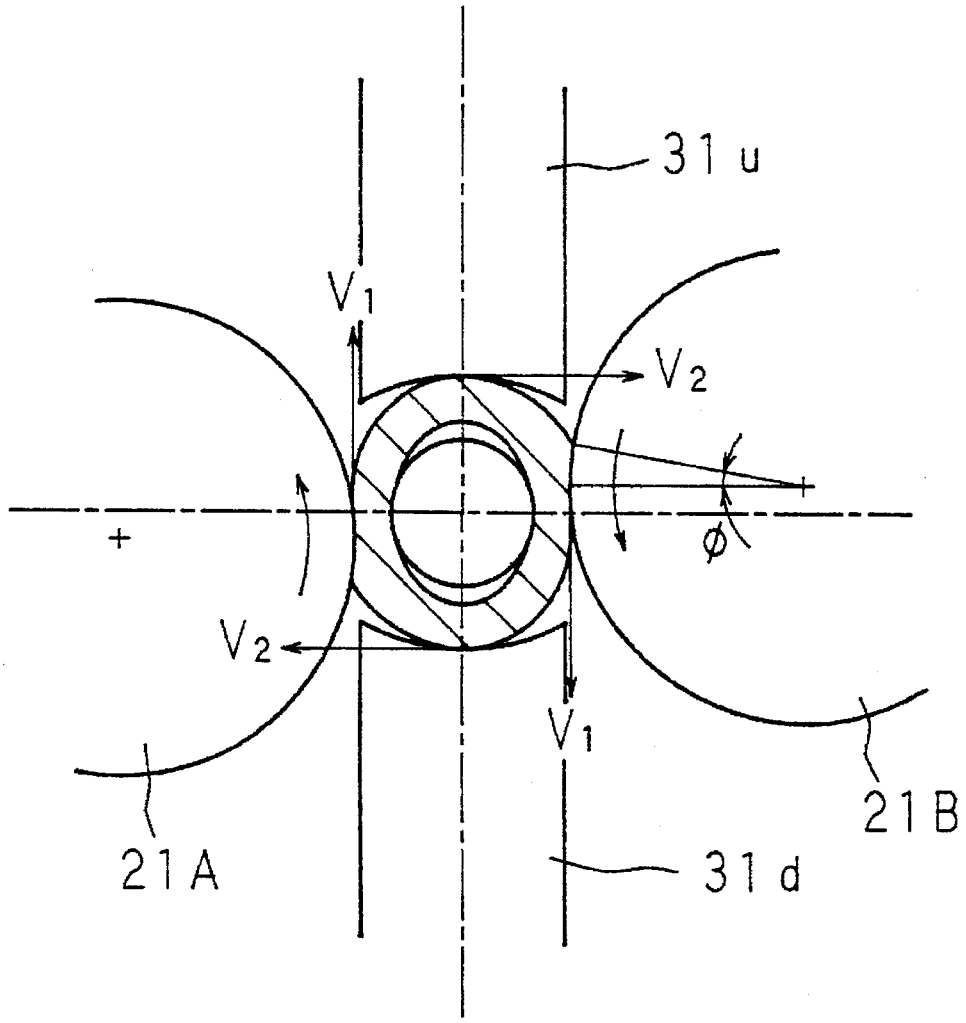
FIG. 6 is a cross sectional view showing the state of piercing/rolling operation for the explanation of the average revolutionary speed of the material during normal piercing/rolling operation.
Figure 7:
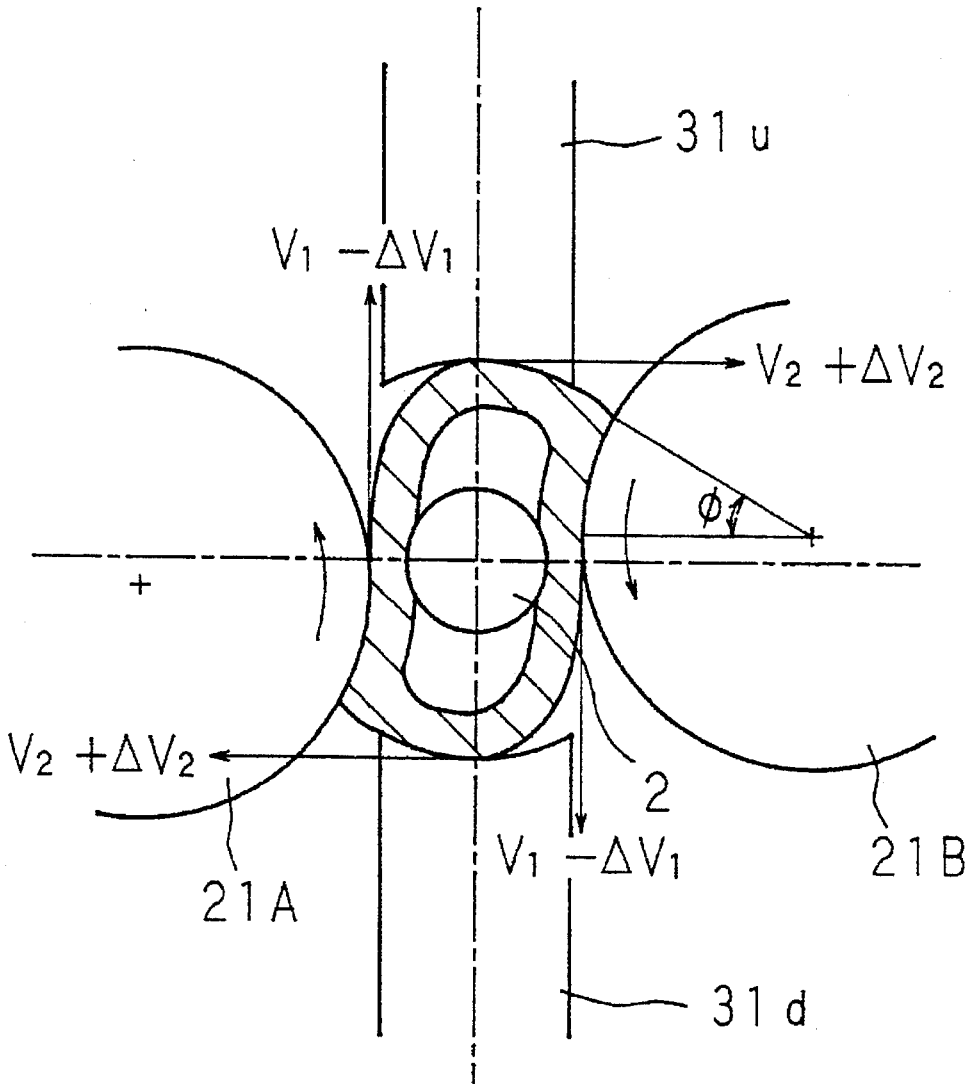
FIG. 7 is a cross sectional view showing the state of piercing/rolling operation for the explanation of the average revolutionary speed of the material during piercing/rolling operation with a high expansion ratio of outer diameter.

Now the reason why the bulging of the material outer diameter at part B on the engagement side of the main roll shown in FIG. 4 increases when piercing/rolling with a high expansion ratio of outer diameter is carried out will be described below. the revolutionary speed of the material in the cross section during the normal piercing/rolling operation is as shown in FIG. 6. In FIG. 6, V1 denotes average revolutionary speed of the material in the contact region with the main rolls 21A, 21B, and V2 denotes average revolutionary speed of the material in the disk roll sliding face. Revolutionary speed of the material in the cross section during piercing/rolling operation with high expansion ratio of the outer diameter is as shown in FIG. 7. The point of departure of the hollow shell from the main rolls is located in the latter half of the main roll outlet side when compared to the case of normal piercing/rolling operation, causing the distance between the pair of disk rolls to increase in the latter half of the outlet side because the disk rolls form circles, resulting in decreasing resistance of the disk rolls against the material. As a result, the average revolutionary speed of the material in the disk roll sliding face increases over that during normal piercing/rolling operation by $\Delta V2$ to become $V2+\Delta V2$. 0n the other hand, the average revolutionary speed of the material in the region of contact with the main rolls 21A, 21B decreases by $\Delta V1$ to become $V1-\Delta V1$, because the contact angle of main rolls $\phi$ increases as the expansion ratio of the outer diameter increases, and therefore slip between the main rolls and the material increases. Thus because the amount of material released per unit time by the disk rolls in the direction of rotation of the material toward the main roll 21B increases while the amount of material engaged by the main roll 21B per unit time decreases, the material becomes stagnant between the disk roll 31*u* and the main roll 21B and bulges outward.

The invention has been made in consideration of the cause of the material outer diameter to bulge at part B at the outlet side of the main roll during piercing/rolling operation with high expansion ratio of outer diameter as described above. The disk rolls are skewed with respect to the pass line to give velocity in a direction reverse to the rotating direction of the material thereby decreasing the speed of releasing from the disk roll sliding surface and, consequently, to decrease the amount of material released per unit time and suppress the bulging of the material outer diameter at the part B on the engaging side of the main roll. Also because the contact angle $\phi$ of the main rolls decreases at this time, the rate of slippage on the main roll side decreases leading to a decreased value of $\Delta V1$ shown in FIG. 7 which increases the engaging velocity in the rotating direction of the material by the main rolls, thereby to suppress the bulging of the material outer diameter at the part B on the engaging side of the main roll. Synergistic effect of $V2+\Delta V2$ reversibly decreasing to V2 and $V1-\Delta V1$ reversibly increasing to V1 makes it possible to completely suppress the bulging of the material outer diameter at the part B on the engaging side of the main roll, and carry out stable piercing/rolling operation without incomplete release from the main rolls.

The present inventors conducted piercing/rolling operations under various conditions with different skew angles $\delta$ of the disk rolls and different expansion ratios of the outer diameter, and obtained the following findings. Piercing/rolling conditions of these operations were as follows. Main rolls of barrel type and cone type were used. Results of these processes (shear strain due to surface twist) are shown in FIG. 8.

Sample Material: Solid round billet of the outer diameter 70 mm made of S45C
Inlet face angle ($\theta 1$) of the main roll: 3°
Outlet face angle ($\theta 2$) of the main roll: 3°
Diameter of main roll gorge portion: 410 mm
Feed angle ($\beta$) of the main roll: 12°

Figure 8:
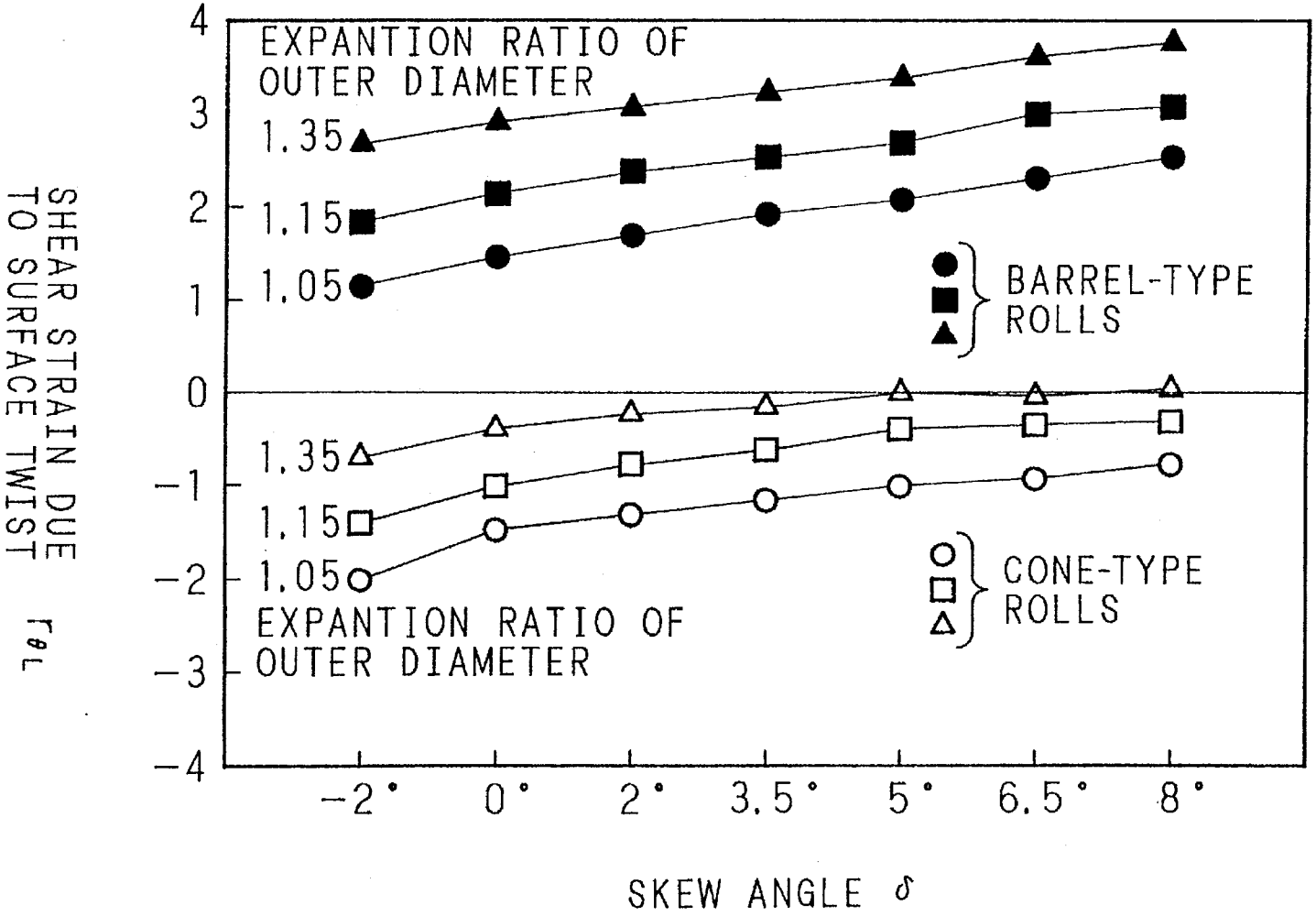
FIG. 8 is a graph showing shear strain due to surface twist during piercing/rolling operation with the skew angle of the disk rolls and the expansion ratio of outer diameter being changed.
Figure 9A:
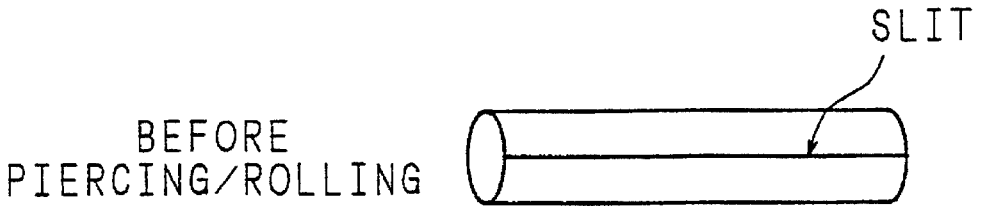
FIGS. 9*a* and 9*b* are schematic diagrams explaining the method of measuring the shear strain due to surface twist.
Figure 9B:
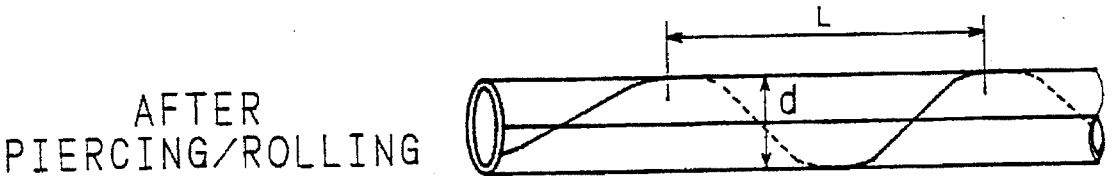

The shear strain due to surface twist which is used as an index of the result shown in FIG. 8 is an additional shearing deformation that causes flaws on the hollow shell outer surface and is obtained from the amount of twist of a slit caused by a piercing/rolling operation after cutting the straight slit on the outer surface of the billet as shown in FIGS. 9*a* and 9*b*. The barrel type main rolls and the cone type main rolls cause shear strain due to surface twist in opposite twisting directions, while the twisting direction caused by the barrel type rolls was assumed to be positive. The sign of the skew angle $\delta$ was assumed to be positive when the skew is caused in the direction toward the main rolls located at the side where the material enters into the disk roll sliding surface.

In the case of the piercing/rolling operation where barrel type main rolls are used, the shear strain due to surface twist increases as the skew angle 6 increases and as the expansion ratio of the outer diameter increases, as will be seen from the results shown in FIG. 8. In the case of the piercing/rolling operation where the cone type main rolls are used, on the other hand, the shear strain due to surface twist decreases as the skew angle $\delta$ increases and as the expansion ratio of the outer diameter increases, as will be seen from the results shown in FIG. 8, resulting in better outer surface quality being obtained.

Thus it was found that, by skewing the disk rolls with respect to the pass line in such a direction as the revolutionary speed of the material decreases, the only result obtained is further deteriorated outer surface quality of the hollow shell in case the barrel type main rolls are used, showing that it is not suitable for piercing/rolling operation with a high expansion ratio of the outer surface, while giving similar skew to the disk rolls when employing the cone type main rolls resulted in improved outer surface quality of the hollow shell thereby making it suitable for the piercing/rolling operation with high expansion ratio of the outer surface.

The present inventors also conducted the piercing/rolling operations under various conditions while changing the outlet face angles $\theta 2$ of the main rolls, skew angles $\delta$ of the disk rolls and the expansion ratios of the outer diameter by using cone type main rolls, and obtained the following findings. Piercing/rolling conditions of these operations were as follows. Results of these processes are shown in FIG. 10.

Sample material: Solid round billet of the outer diameter 70 mm made of S45C
Inlet face angle ($\theta 1$) of the main roll: 3°
Outlet face angle ($\theta 2$) of the main roll: 3° to 5°
Diameter of main roll gorge portion: 410 mm
Cross angle ($\gamma$) of the main roll: 20°
Feed angle ($\beta$) of the main roll: 8° to 12°
Ratio of wall thickness t to outer diameter d (t/d) of the hollow shell: 0.05 to 0.06

Figure 10:
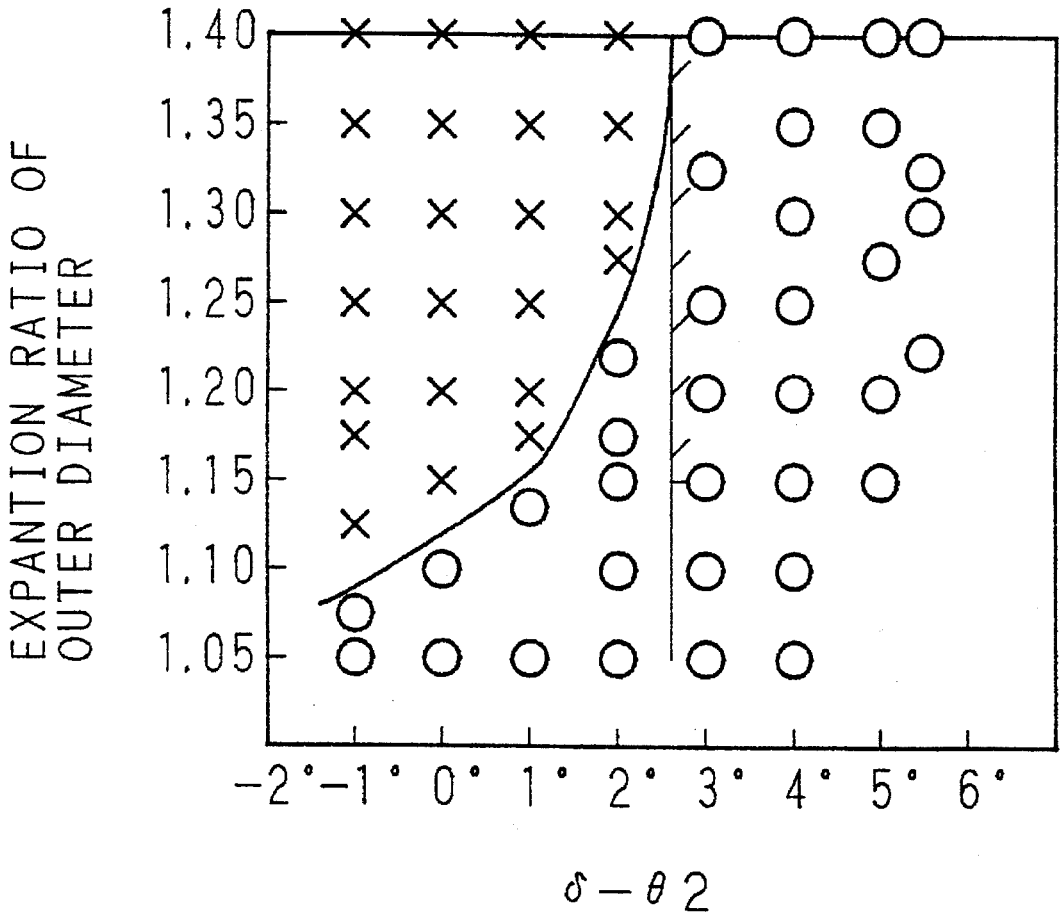
FIG. 10 is a diagram showing the result of piercing/rolling operation with the outlet face angle of the main rolls, skew angle of the disk rolls and the expansion ratio of outer diameter being changed.

In FIG. 10, mark x indicates a case where incompleted release from the main rolls or flaws on the outer surface occurred, and mark ○ indicates a case where satisfactory piercing/rolling operation was carried out. From the results shown in FIG. 10, it is clear that increasing the skew angle 6 results in better result in the case of the piercing/rolling operation with a high expansion ratio of the outer diameter. It is also shown that the piercing/rolling operation with an expansion ratio of the outer diameter of 1.15 or higher value requires to make the skew angle $\delta$ at least 2° larger than the outlet face angle $\theta 2$ of the main rolls.

Now the reason of defining the range of skew angle 6 which is set on the basis of the findings described above in the invention will be described below. Although a larger skew angle $\delta$ makes it possible to suppress shear strain due to surface twist and incompleted release from the main rolls, there is an upper limit to the angle imposed by restriction of the facility and therefore the upper limit is set to 9°. Also because the piercing/rolling operation with a high expansion ratio of the outer diameter can be carried out when the skew angle $\delta$ is at least 2° larger than the outlet face angle $\theta 2$ of the main rolls, the lower limit is set to $\theta 2+2°$. For these reasons, the above conditions (1) are set. Meanwhile increasing the skew angle δ too much with respect to the inlet face angle θ1 of the main rolls leads to increased space between the inlet face of the main roll and the side face of the disk roll resulting in insufficient pressing against the material at the inlet face in the direction of the disk roll and increased enlargement of the outer diameter of the material in the guiding direction, so that the eclipse ratio (ratio of maximum diameter to minimum diameter of the cross section of the material) increases and the incomplete engagement occurs. In order to prevent this failure, the range of skew angle δ with respect to the inlet face angle θ1 of the main rolls is set to the condition (2).

Figure 11:
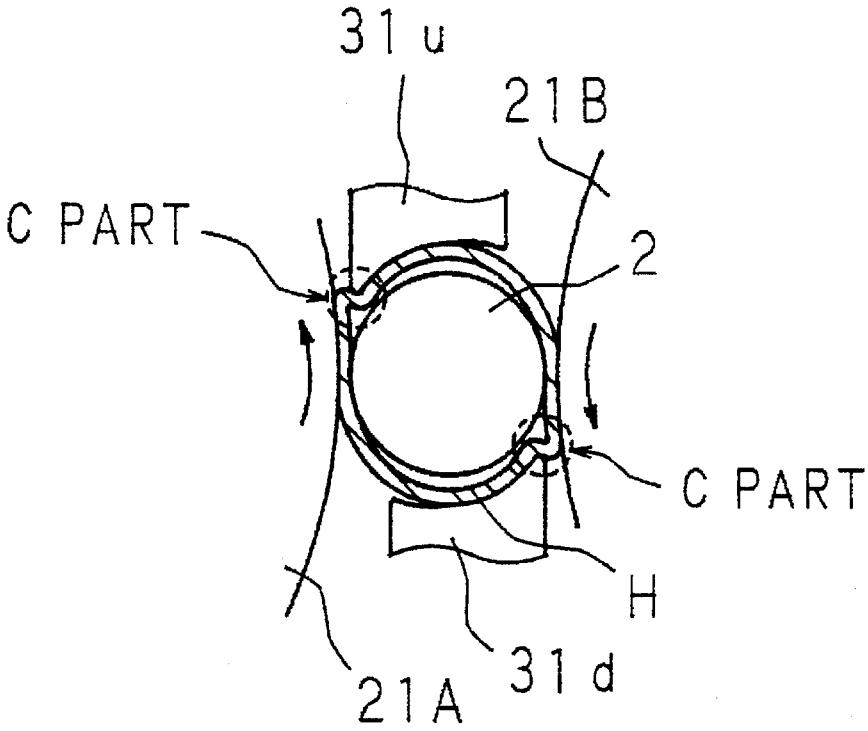
FIG. 11 is a cross sectional view showing the state of piercing/rolling operation for the explanation of problems of the prior art.

The piercer disclosed in the Japanese Patent Application Laid-Open No. 63-90306 (1988) is provided with an inclining mechanism that disposes the disk rolls substantially parallel to the outlet face angle of the main roll and a moving mechanism that sets the distance between the main roll and the disk roll to nearly zero, thereby to prevent the material from being squeezed out in part C shown in FIG. 11 and stabilize the material configuration. In the piercing/rolling operation with a high expansion ratio of the outer diameter dealt with by the invention, on the other hand, the problem of focus is not the squeezing out of the material to the side of entry to the disk roll sliding surface, but the incomplete release from the main rolls due to the increased contact angle of main rolls in the rotating direction of the material and flaws on the outer surface, as described above. The invention has been made to solve these problems.

The invention is a technology to prevent incomplete release from main rolls by decreasing the contact angle of main rolls and make it possible to carry out the piercing/rolling operation with high expansion ratio of the outer diameter, simply by imparting a velocity component reverse to the rotating direction to the material, and is essentially different from technologies that make the distance between the main roll and the disk roll nearly zero over the rolling region such, as one disclosed in the Japanese Patent Application Laid-Open No. 63-90306 (1988). With the technology as disclosed in the Japanese Patent Application Laid-Open No. 63-90306 (1988) where the disk rolls are disposed in parallel to the outlet face angle of the main rolls, stable piercing/rolling operation with high expansion ratio of the outer diameter cannot be carried out as can be seen from the result shown in FIG. 10. According to the invention, stable piercing/rolling operation with high expansion ratio of the outer diameter can be carried out by employing a specified main roll configuration (cone shape), skewing the disk rolls by an angle at least 2° larger than the outlet face angle (the above condition (1)) and limiting the skew angles of the disk rolls with respect to the inlet face angle within a particular range (the above condition (2)).

Preferred embodiments of the invention will now be described below.

Figure 12:
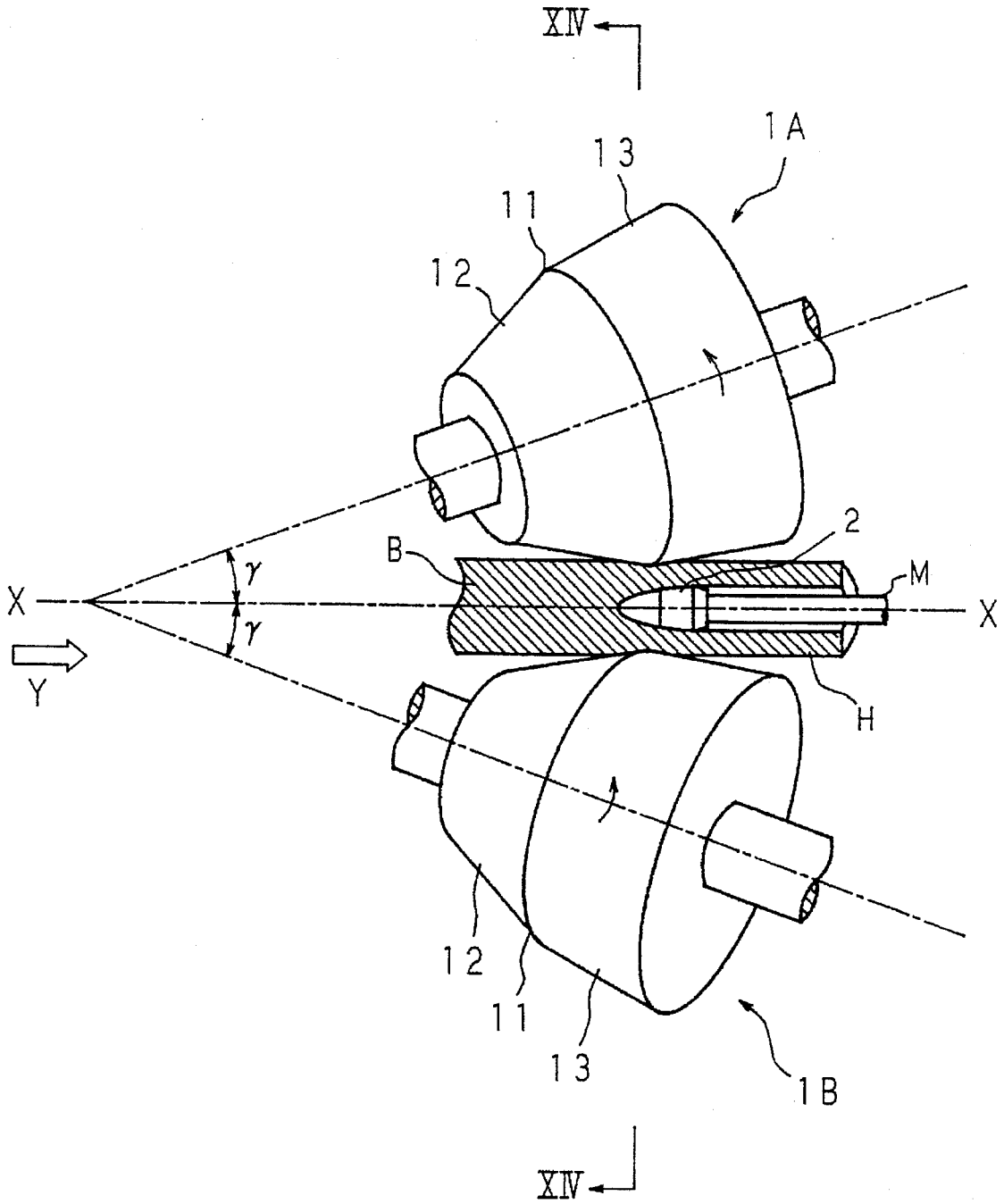
FIG. 12 is a schematic plane view of the piercer according to an embodiment of the invention.
Figure 13:
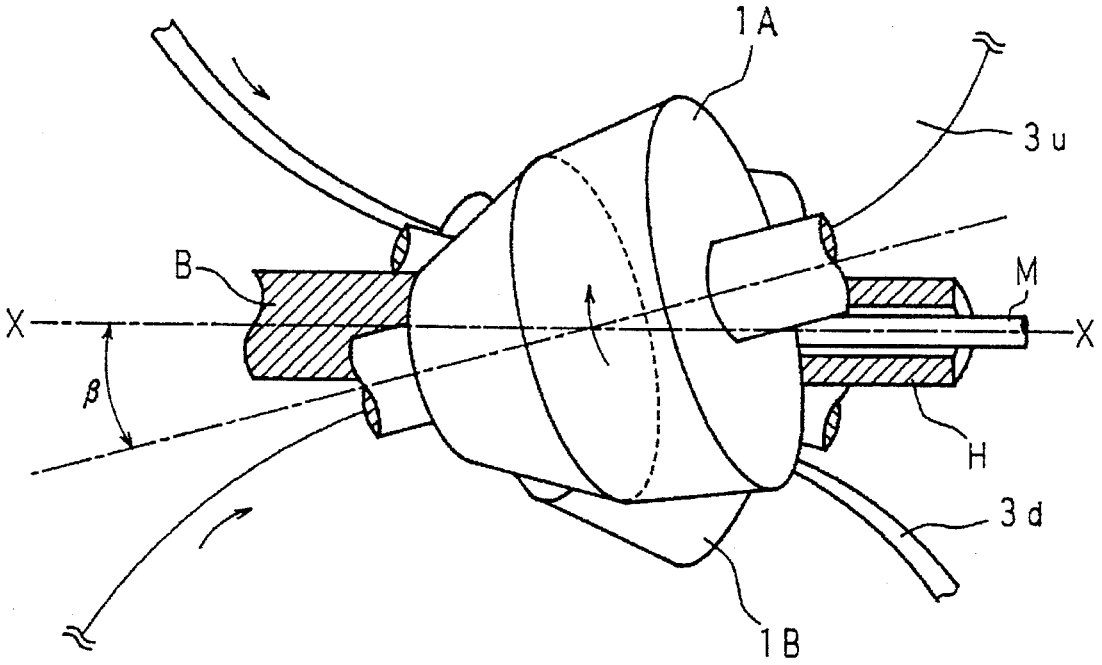
FIG. 13 is a schematic side view of the piercer according to the embodiment of the invention.
Figure 14:
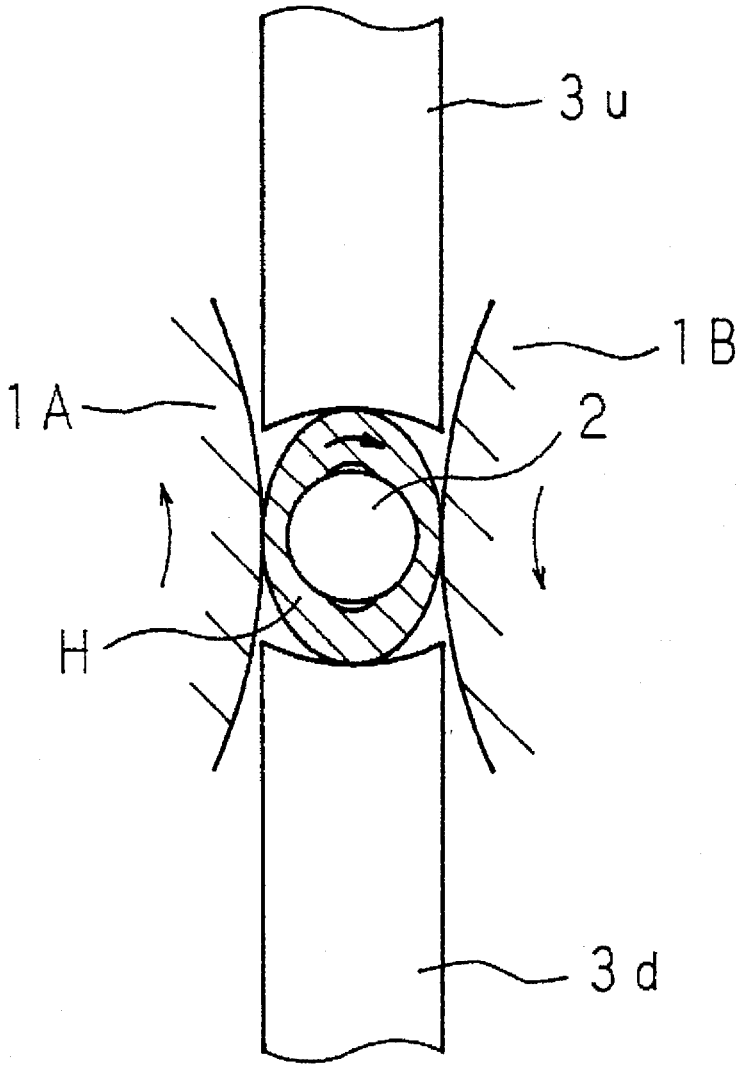
FIG. 14 is a cross sectional view taken in the line XIV–XIV of FIG. 12.
Figure 15:
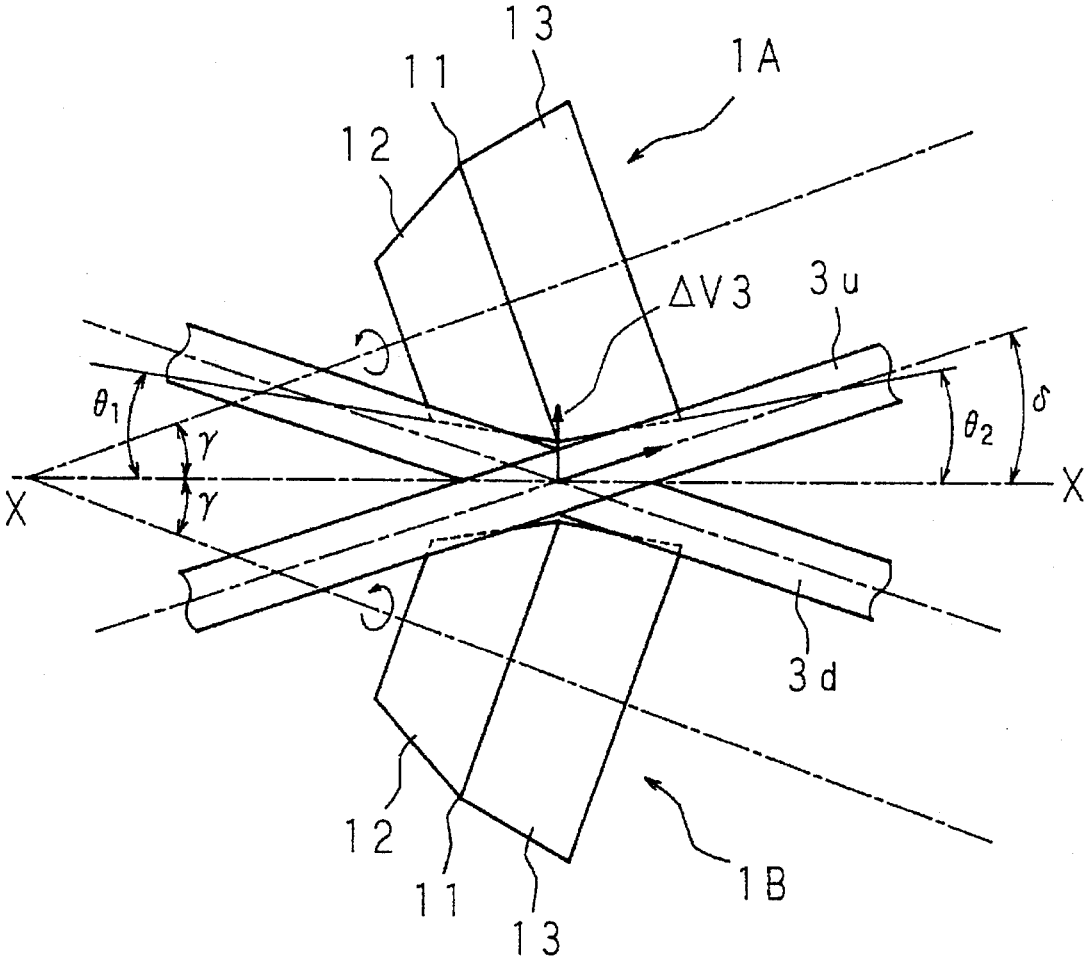
FIG. 15 is a schematic plane view of the piercer according to an embodiment of the invention where the main rolls are not given a feed angle.

FIG. 12 is a schematic plane view of the piercer used in an embodiment of the invention, FIG. 13 is a schematic side view thereof, FIG. 14 is a cross sectional view taken in the line XIV—XIV of FIG. 12, and FIG. 15 is a schematic plane view of the piercer used in an embodiment of the invention where the main rolls are not give a feed angle.

The piercer used in this embodiment has a pair of main rolls 1A, 1B, a plug 2 and a pair of disk rolls **3*u*, 3*d*. Symbol B denotes a billet transferred in the direction indicated by the hollow arrow mark Y, which is subjected to the piercing/rolling operation to become a hollow shell H and is drawn out. In FIGS. 12, 13, 15, the inlet side of the piercing process is drawn on the left and the outlet side of the piercing process is drawn on the right side. FIG. 14** shows a cross section viewed from the inlet side of the piercing process.

The main rolls 1A, 1B have gorge portions 11 of short cylindrical configuration near the middle portion in the axial direction thereof, which is interposed by an inlet portion 12 substantially formed in a truncated cone whose diameter reduces toward the end on the inlet side and whose inlet face angle is θ1 and an outlet portion 13 substantially formed in a truncated cone whose diameter increases toward the end on the outlet side and whose outlet face angle is θ2, thereby forming an overall configuration of the conical type. The main rolls 1A, 1B are inclined from the pass line X—X by a feed angle β as shown in FIG. 13, and are disposed on both sides of the pass line X—X of the billet B while each of the main rolls is inclined by a specified cross angle γ with respect to the pass line X—X as shown in FIG. 12. The main rolls 1A, 1B are so arranged as to be rotated around the axes thereof by driving devices not shown in the drawing.

The plug 2 has an overall configuration of a bullet, with the base end thereof being supported on the tip of a mandrel bar M. The plug 2 is positioned on the pass line X—X to be held thereon at the middle of the space between the main rolls 1A, 1B, and is capable of rotating about the pass line X—X. The base of the mandrel bar M is linked to a thrust block which is not shown in the drawing.

The disk roll **3*u* is disposed, with the sliding face of a concave configuration thereof opposing the moving region of the billet B, while being skewed toward the main roll 1A side with a skew angle δ which is 2° larger than the outlet face angle θ2 of the main roll 1A, as shown in FIG. 15, so that a velocity component ΔV3 in a direction reverse to the rotating direction of the billet B can be imparted. The disk roll 3*d* is disposed while being skewed by the same angle (skew angle δ) in a direction reverse to that of the disk roll 3*u*. The disk rolls 3*u*, 3*d*** are driven to rotate in the rotating direction of the billet B by driving devices not shown in the drawing.

In such a piercer as described above, the round billet B which has been heated to a specified temperature in a heating furnace is transferred with the axis thereof being aligned with the pass line X—X in the direction indicated by the hollow arrow mark Y, and is engaged by inlet portions 12, 12 of the main rolls 1A, 1B at the tip thereof. Then the billet B is moved along the pass line X—X by the disk rolls **3*u*, 3*d* and is pierced and rolled while receiving intermittent pressing once every half turn between the main rolls 1A, 1B and the plug 2, that is moved screwing along the pass line X—X by the revolution of the main rolls 1A, 1B. When the billet B is not pressed, the material is squeezed to the outside in the radial direction by the rotation of the billet B as shown in FIG. 14, although the disk rolls 3*u*, 3*d*** make sliding contact with the circumference of the portion which is squeezed out, thereby suppressing the engagement of outer diameter beyond this surface of sliding contact. As a result, the material is rolled while showing elliptical configuration, and is formed gradually into a circular shape as the material moves downstream in the direction of transfer, so that the hollow shell H is drawn out.

The result of actually carrying out the piercing/rolling operation according to the invention will now be described below. Conditions of the piercing/rolling operation are as follows, and the result of the operation are shown in TABLE 1. Results of a reference operation carried out for the purpose of comparison under conditions out of the range of this invention are also shown in TABLE 1.

Billet: Continuously cast 0.2% carbon steel 70 mm in diameter

Expansion ratio of the outer diameter: 1.3 to 1.45

Ratio of wall thickness t to outer diameter d (t/d) of the hollow shell: 0.05

Cross angle (γ) of the main roll: 20°
Feed angle (β): 12°
Inlet face angle (θ1): 3°, 3.5°, 4°
Outlet face angle (θ2): 3°, 4°, 5°, 6°
Skew angle (δ): 0° to 9°
Velocity of disk rolls in rolling direction: 1.1×Velocity of hollow shell in rolling direction

TABLE 1

| | Skew angle δ | Outlet face angle θ2 | Inlet face angle θ1 | Occurrence of incompleted release from the main rolls | Occurrence of flaw on outer surface | Occurrence of incompleted engagement |
|---|---|---|---|---|---|---|
| Reference 1 | 0° | 3° | 3° | x | x | o |
| | 5° | 3° | x | x | o | |
| Reference 2 | 3.5° | 3° | 3° | x | x | o |
| | 4° | 3° | x | x | o | |
| Reference 3 | 5° | 5° | 3° | x | x | o |
| Example of the invention | 6.2° | 3° | 3° | o | o | o |
| | 4° | 3° | o | o | o | |
| Example of the invention | 7.5° | 4° | 3° | o | o | o |
| | 5° | 3° | o | o | o | |
| Example of the invention | 8.5° | 5° | 3° | o | o | o |
| | 6° | 3° | o | o | o | |
| Reference 4 | 8.5° | 3° | 4° | — | — | x |
| | 9° | 5° | 3.5° | — | — | x |

In TABLE 1, mark x in the column of occurrence of incomplete release from the main rolls indicates that an incompleted release occurred. Mark x in the column of occurrence of flaw on outer surface indicates that flaw was generated on the outer surface of the tube due to shear strain due to surface twist, or the disk shoe mark was generated on the outer surface of the hollow shell. Further, mark x in the column of occurrence of incompleted engagement indicates that an incomplete engagement occurred. Mark ○, on the other hand, indicates that such a problem did not occur. Mark—indicates that it could not be determined whether such a problem occurred or not.

As will be clear from the results shown in TABLE 1, incomplete release from the main rolls and flaw on the outer surface occurred in the reference cases 1 through 3 which did not satisfy the above condition (1) ($\theta 2+2° < \delta < 9°$). In the reference case 4 which did not satisfy the above condition (2) ($\delta+\theta 1<12°$), incomplete engagement occurred. In all examples of the invention which satisfied the above conditions (1) and (2), the piercing/rolling operation with high expansion ratio of the outer diameter can be carried out stably while improving the quality of the hollow shell outer surface without occurrence of mis-rolling and makes it possible to greatly expand the range of steel tubes which can be manufactured with the piercer.

According to the invention, as described in detail above, because the cone-type main rolls are used and the skew angle of the disk rolls, the outlet face angle and the inlet face angle of the main rolls are set in such particular ranges as described above, the piercing/rolling operation with high expansion ratio of the outer diameter (1.15 or higher) can be carried out smoothly without such troubles as incompleted release from main rolls, flaw on the tube outer surface and incompleted engagement, making it possible to greatly expand the range of steel tubes that can be manufactured and to reduce the manufacturing cost thereof.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A piercing/rolling method for seamless steel tube wherein a material to be rolled is pierced and rolled while being screwed and moved forward to obtain a seamless steel tube, comprising the steps of:

disposing a pair of cone-type main mils and a pair of disk rolls alternately with each other about a pass line under the following conditions;

the disk rolls having a sliding face and being inclined by a skew angle δ with respect to the pass line toward the main roll located at the entry side where the material enters into the disk roll sliding face, so as to be unparallel with an outlet face angle of the main roll, the skew angle δ being set to satisfy the following conditions (1) and (2):

$$\theta 2+2° < \delta < 9° \quad (1)$$

$$\delta+\theta 1<12° \quad (2)$$

where θ1 is an inlet face angle of the main roll

θ2 is the outlet face angle of the main roll disposing a plug for piercing the material along the pass line between the main rolls and the disk rolls.

2. A piercing/rolling method as claimed in claim 1, wherein the expansion ratio of the outer diameter of the material, which represents the ratio of the outer diameter of the material after piercing to the outer diameter of the material before piercing, is 1.15 or higher.

3. A piercing/rolling method as claimed in claim 2, wherein the expansion ratio of the outer diameter of the material is in a range from 1.3 up to 1.45.

4. A piercing/rolling method as claimed in claim 1, wherein the inlet face angle θ1 of the main roll is in a range of $3° \leqq \theta 1 \leqq 4°$.

5. A piercing/rolling method as claimed in claim 1, wherein the outlet face angle θ2 of the main roll is in a range of $3° \leqq \theta 2 \leqq 6°$.

6. A piercing/rolling apparatus for seamless steel tube wherein a material to be rolled is pierced and rolled while being screwed and moved forward to obtain a seamless steel tube, comprising:

a pair of cone-type main rolls disposed about a pass line, the main rolls having an inlet face angle and an outlet face angle;

a pair of disk rolls disposed alternately with the pair of main rolls about the pass line under the following conditions;

the disk rolls having a sliding face and being inclined by a skew angle δ with respect to the pass line toward the main roll located at the entry side, where the material enters into the disk roll sliding face, so as to be unparallel with the outlet face angle of the main roll, the skew angle δ being set to satisfy the following conditions (1) and (2):

$$\theta 2 + 2° < \delta < 9° \quad (1)$$

$$\delta + \theta 1 < 12° \quad (2)$$

where θ1 is the inlet face angle of the main roll

θ2 is the outlet face angle of the main roll a plug, disposed along the pass line between the main rolls and the disk rolls, for piercing the material.

7. A piercing/rolling apparatus as claimed in claim 6, wherein the expansion ratio of the outer diameter of the material, which represents the ratio of the outer diameter of the material after piercing to the outer diameter of the material before piercing is 1.15 or higher.

8. A piercing/rolling apparatus as claimed in claim 6, wherein each of the pair of main rolls includes a gorge portion of short cylindrical configuration that is located between an inlet portion and an outlet portion, the inlet portion being substantially shaped in a truncated cone having a diameter that decreases from the gorge portion toward an inlet end of the main roll, the inlet portion having the inlet face angle θ1, and the outlet portion being substantially shaped in a truncated cone having a diameter that decreases from the gorge portion toward an outlet end of the main roll, the outlet portion having the outlet face angle θ2.

9. A piercing/rolling apparatus as claimed in claim 6, wherein each of the pair of disk rolls has a disk shape with the peripheral surface which faces the plug being formed in a concave configuration.

* * * * *